US005165359A

United States Patent [19]

Tandeo et al.

[11] Patent Number: 5,165,359

[45] Date of Patent: Nov. 24, 1992

[54] PRESSURE TIGHT HULL CONVERTIBLE SUBMARINE

[75] Inventors: François Tandeo, St. Cloud; Jean A. Le Tallec, St. Germain en Laye; Jean L. Gaillard, Asnieres; Gérald Boisrayon, Clamart; Edouard Fontaine, Paris, all of France

[73] Assignee: ETAT Francais represented by the Delegue general pour l'armement, Paris, France

[21] Appl. No.: 701,071

[22] Filed: May 16, 1991

[30] Foreign Application Priority Data

Jun. 8, 1990 [FR] France ..... 90 07124

[51] Int. Cl.[5] ..... B63H 21/18

[52] U.S. Cl. ..... 114/312; 114/65 R; 114/337

[58] Field of Search ..... 114/65 R, 312, 337, 114/341, 342, 338; 440/3

[56] References Cited

U.S. PATENT DOCUMENTS

| | | | |
|---|---|---|---|
| 1,324,880 | 12/1919 | Cronenberg | 114/342 X |
| 1.870,263 | 8/1932 | Neff | 114/338 |
| 3,008.889 | 11/1961 | Junkins | 114/338 X |
| 3,765,359 | 10/1973 | Takezawa et al. | 114/77 R |
| 4,031,838 | 6/1977 | Schmidt et al. | 114/1 |
| 4,048,936 | 9/1977 | Uchizono et al. | 114/65 R |
| 4,175,908 | 11/1979 | Andersson | 414/786 |
| 4,398,484 | 8/1983 | Pierart | 114/65 R |
| 4,553,493 | 11/1985 | Sadler et al. | 114/1 |
| 4,709,646 | 12/1987 | Sadler et al. | 114/5 |

FOREIGN PATENT DOCUMENTS

| | | | |
|---|---|---|---|
| 0014661 | 8/1980 | European Pat. Off. . | |
| 0082539 | 12/1982 | European Pat. Off. . | |
| 2625632 | 6/1978 | Fed. Rep. of Germany . | |
| 2114625 | 6/1972 | France . | |
| 2276985 | 1/1976 | France . | |
| 2354237 | 1/1978 | France . | |
| 2528091 | 12/1983 | France . | |
| 240589 | 11/1985 | Japan | 114/65 R |
| 77585 | 4/1986 | Japan | 114/65 R |
| 7794 | 2/1916 | United Kingdom . | |
| 148605 | 7/1920 | United Kingdom . | |
| 2001013 | 1/1979 | United Kingdom . | |
| 2121452A | 12/1983 | United Kingdom . | |

*Primary Examiner*—Sherman Basinger
*Attorney, Agent, or Firm*—Oliff & Berridge

[57] ABSTRACT

The present invention concerns a convertible the capable of being transformed to change from a conventional mode of propulsion to a nuclear mode of propulsion. The submarine includes an aft section delimited by a pressure tight hull and two transverse bulkheads in which are located electric energy production and storage installations using batteries and diesel-generators. The aft section can be transformed to convert the submarine to the use of an anaerobic energy source by substituting for these installations, installations adapted to the anaerobic source of energy while preserving the integrity of the pressure tight hull and bulkheads, without internal substitution causing any substantial modification in the weight or centering of the aft section.

20 Claims, 7 Drawing Sheets

PRESSURE TIGHT HULL CONVERTIBLE SUBMARINE

BACKGROUND OF THE INVENTION

1. Field of the Invention

The present invention concerns the field of submarines and more particularly the way their architecture is organized.

2. Description of Related Art

Existing pressure hull submarines are, in theory, originally designed for a "conventional" propulsion mode in which the battery and diesel-generator system is used, or for the use of an anaerobic energy source of the nuclear or of another type with, possible in this case, a smaller battery.

The term pressure hull submarine will refer to any submarine having a hull designed to resist the external diving pressure and to permit the maintenance inside of an atmosphere suitable for the operation of the equipment and for the life of the crew.

Further, the term energy anaerobic source will refer to a source of energy not requiring a supply of atmospheric air from outside the submarine.

Submarines associated with a propulsion mode using batteries and diesel-generators at the present time have a lifespan of thirty years or so and, in theory, preserve their technical capabilities during that time if they are properly designed, built and maintained.

But submarines such as this may become insufficient during operation, partly because of the rapid progression made in the aptitudes of the adversaries they are liable to encounter and further because of the technical evolutions making it possible to design new equipment which may substantially improve the capabilities of submarines in the fulfilling of their missions.

Often, the refurbishing of submarines at midlife is scheduled, i.e. after approximately 15 years of duty, but the transformations during such refurbishing are always limited.

These transformations are essentially aimed at improving the detection capabilities of the submarine and its weaponry (torpedoes, mines), its tactical aids, its transmission means and its navigation instruments. Accordingly, transformations such as these consist of simple replacement of simple equipment by other equipment of similar volumes within the structure of the submarine, the central operations station, the weapons station, the submarine front structure and the technical rooms concerned.

Accordingly, transformations made at midlife on submarines only concern individual stations and in no case do they make any definite improvement to the characteristics of range, diving autonomy and maximum speed nor do they reduce the indiscretion related to the needs of sailing at periscope depth.

Accordingly, it would be extremely advantageous, under acceptable financial conditions, to transform a conventional propulsion submarine in order to secure a substantial improvement in the aforementioned characteristics, more particularly by converting it to the nuclear propulsion mode. At the present time, there is no design for a convertible submarine.

In a prior embodiment, surface ships have been equipped with a unit forming a nuclear reactor, by initially building the ship in two prefabricated sections, one including a housing into which, before the assembly of the two parts, a block forming the nuclear reactor is slipped into place horizontally: this method of construction is, for instance, that described in the application for European patent No. 0 014 661.

But this known embodiment of the technique does not convert a surface ship to transform it from conventional propulsion to nuclear propulsion but simply equips such ships directly for use under nuclear power so that the installations and equipment associated with this method of propulsion are always provided for as of the design stage.

What is more, this technique would be extremely delicate to implement in the case of a submarine.

There are also methods of construction for surface ships, one of which is the prior British patent No. 2 001 013 and U.S. Pat. No. 3,765,359.

The state of the technique can also be completed by referring to the processes of loading and unloading heavy objects onto a surface ship using more or less sophisticated lifting facilities, as for instance those illustrated in French patent No. 2 354 237 and German patent No. 26 25 632.

An expert might further be tempted to transpose, for submarines, the modular construction techniques already proposed for surface ships in order to reach a level of convertibility by the replacement of functional modules.

But, not only are these techniques still limited to the replacement of functional weaponry, identification or fire control units (see, for instance, the European patent application No. 0 082 539, U.S. Pat. No. 4,709,646 and French patent No. 2 114 625), or yet again, modules forming accommodation or loading spaces (for instance, see French patent No. 2 528 091), but with which there is no valid means of transposition so that submarines could be converted into a state making them apt to to accept a method of propulsion differing from the conventional battery and diesel-generator solution.

SUMMARY OF THE INVENTION

The purpose of this invention is to propose a convertible pressure hull submarine architecture by which submarines could be transformed under the best possible conditions so as to be able to change, in a totally operational manner, from a conventional propulsion version at the origin to an improved anaerobic version with an anaerobic energy source (of the nuclear type or of another) and a battery the size of which could be considerably reduced with respect to the original.

This concept should make it possible to benefit in the longer term from sophisticated technologies which have not been chosen during the construction of the submarine (or for which the choice was not available because they were not duly qualified) while having, in the immediate future, submarines equipped with totally controlled techniques. This concept should also limit the impact of transformation upon the conditions of operation and servicing of submarines.

Another purpose of this invention is to design a convertible submarine capable of being transformed during its service life to acquire, under acceptable financial conditions and without any effect upon its other capacities, of an important advantage regarding its characteristics in terms of range, diving autonomy and maximum speed with, in addition, a substantial reduction of its indiscretion for periscope depth navigation so as to considerably improve the capability of the submarine to carry out its action and decisive attack.

Another purpose of the invention is the design of a convertible submarine whose structure preserves technical capabilities other than those referred to in the conversion with, more particularly, compliance with the various balancing conditions of the submarine and maintain safety and military qualities while limiting the work involved to the replacement of the equipment directly concerned which therefore does not result in any additional work on equipment and installations not involved in this transformation.

More particularly, this concerns a pressure hull convertible submarine specific in that it includes a rear section contained by the pressure hull and two transverse bulkheads in which the electric energy storage and production installations using batteries and diesel-generators are located. This section can be transformed to convert said submarine to the use of an anaerobic energy source, in particular of the nuclear type, by replacing these installations by installations adapted to said energy source and preserving the pressure hull and bulkheads, but without this internal substitution causing any substantial modification to the weight (or displacement), and center of gravity of said section.

In one particularly advantageous embodiment, the rear section includes a lower compartment housing batteries placed between two side diesel oil tanks together with a provisional ballast tank and an upper compartment in which two diesel-generator resting on a supporting partition are housed, together with the associated electric equipment while these compartments are transformable by the removal of the supporting bulkhead and the addition of an intermediate transverse bulkhead into a forward compartment housing the electro-nuclear battery unit and an aft compartment housing, on the one hand, a turbo-generator and a condenser associated with said battery and, on the other hand, a back-up diesel-generator, whilst a modified balancing weight is placed in one and/or both of the forward and aft compartments.

Preferably, the transverse forward bulkhead of the aft section will define, with an outer transverse bulkhead of the aft section, an additional compartment adjacent to said section, said additional compartment being used as diesel oil hold and providing, after transformation, radiological protection of the forward zone of the said submarine. In particular, the forward transverse bulkhead of the aft section concerns the entire inner section of the pressure hull while the aft bulkhead of said section concerns, at the very least, the lower compartment while the aft bulkhead may, if necessary, be completed to contain the aft compartment after conversion.

In addition, the convertible submarine could to good advantage include a diesel exhaust circuit located in the superstructure outside the pressure hull; this circuit would include an aft exhaust section and a forward exhaust section opening out at the sail of said submarine which circuit would be transformable during internal substitution so as to include a simplified circuit associated with the back-up diesel-generator.

Further, preferably, the convertible submarine includes at its navigation station, a diesel-generator control console which is replaceable as part of the internal substitution process by another back-up diesel-generator and electro-nuclear battery control console.

According to a preferred characteristic, the aft section has a logistic panel at the pressure hull by which initial installations can be unloaded and replacement installations loaded as part of the internal substitution process. In such a case, it is advantageous for the logistic panel to be provided at the upper part of the aft section near the transverse forward bulkhead which contains said section; more particularly, the logistic panel is provided between the forward transverse bulkhead and the intermediate transverse bulkhead added during an internal substitution operation.

As a variant, the interior of the aft section would be accessible for the internal substitution of installations through a transverse cutout in the pressure hull which cut would be made between the transverse bulkheads containing it, or beyond either one of said transverse bulkheads, but near the transverse bulkhead concerned.

Other characteristics and advantages of the invention will appear more clearly in the light of the following description and the attached drawings concerning a particular embodiment with reference to the figures in which:

BRIEF DESCRIPTION OF THE DRAWINGS

FIG. 12 is a partial end-on sectional view illustrating the empty aft section while

DESCRIPTION OF PREFERRED EMBODIMENTS

Figure 1:
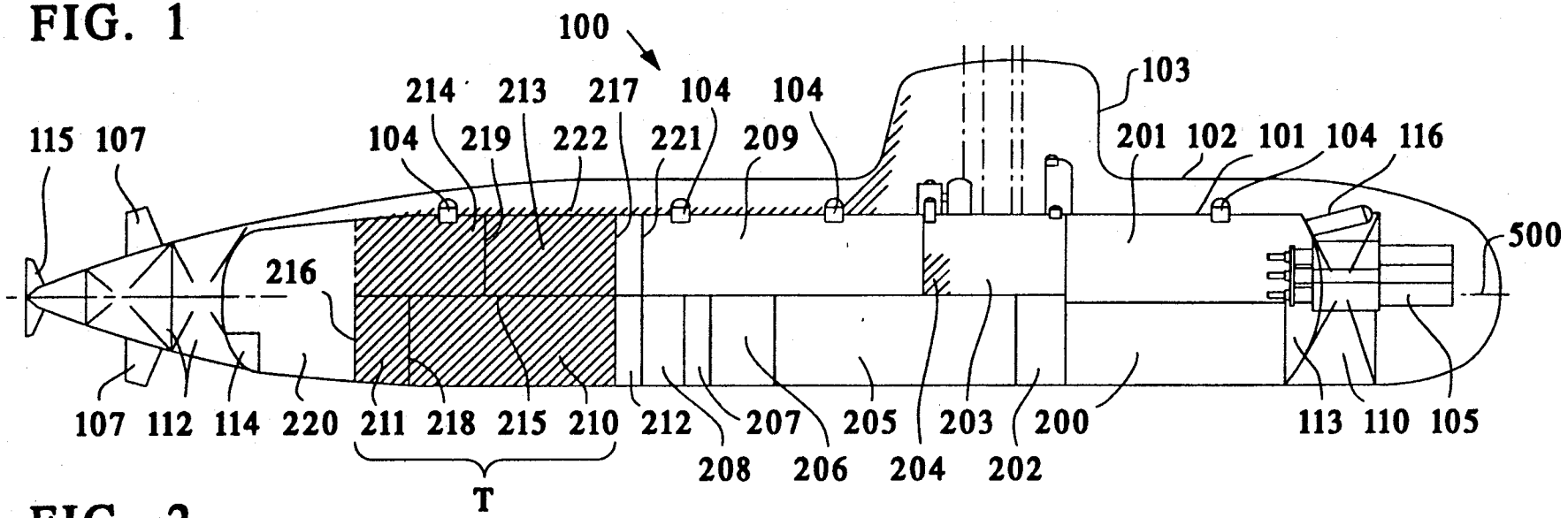
FIGS. 1 and 2 are axial schematic sectional views respectively in the vertical and horizontal planes of a convertible submarine conforming with the invention, with a transformable aft section in which the electric energy production and storage installations are located, using batteries and diesel-generators, while the hatching highlights the areas affected by the transformation with a view to the use of an anaerobic energy source (in this case nuclear)
Figure 2:
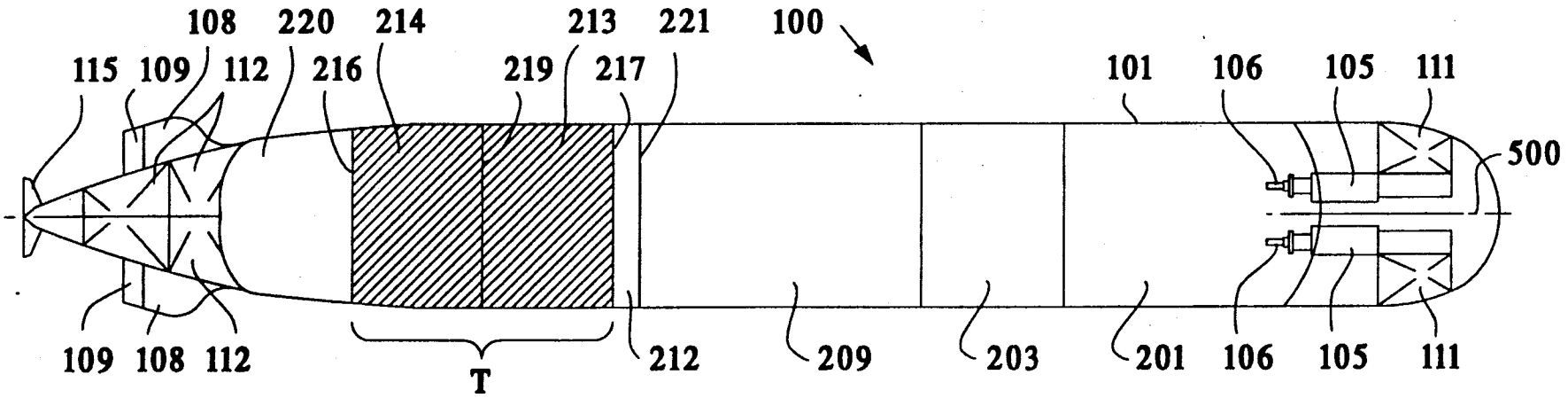

FIGS. 1 and 2 illustrate the convertible submarine 100 in conformity with this invention. This submarine includes a certain number of installations and equipments which are of a known type and which are referred to briefly in the following.

Submarine 100 includes a pressure hull 101 and a deck 102 on which is mounted a sail 103. The pressure hull includes a certain number of access points 104 at the top. In the forward part of the vessel are a number of torpedo launching tubes 105 with their pneumatic rams 106, a set of six tubes being provided in the present case. Opening 116 is designed for the loading of weapons in the pressure hull 101. In the aft section of vessel 100, there are a set of ailerons and steering rudders 107 with rear rudders 108 supporting the diving rudders 109 together with propeller 119. A number of ballasts are included: in the forward section are located ballast 110 and two side semi-ballasts 111 while the aft section of said submarine also discloses ballasts 112. Furthermore, a forward trim tank 113 and an aft trim tank 114 are located within the pressure hull 101. The interior of pressure hull 101 of submarine 100 is sub-divided into a number of compartments, split into two levels with respect to submarine access 500.

Accordingly, we distinguish a compartment 200 containing the forward batteries, atop which is a compartment 201 reserved for the weaponry. In the aft section of this compartment are technical room 202 and compartment 205 designed to contain the forward auxiliary motors and more particularly the adjusting and compensation tanks. Further aft are compartment 206 for quarters and compartment 207 and 208 serving as utility rooms. Above compartment 202, 205, 206, 207, 208 are the operations and navigation control station 203 and behind it, compartment 209 reserved for other quarters. In the aft section of the vessel are compartment 220, often called the engine compartment, containing the electric motor and the flexible coupling and associated thrust bearing (the equipment is not shown here).

In compliance with one essential characteristic of the present invention, convertible submarine 100 includes an aft section T contained by the pressure hull 101 and two transverse bulkheads 216 and 217 containing the installations for the production and storage of electric energy using batteries and diesel-generators said section being transformable so as to convert the submarine to the use of another anaerobic energy source, in particular of the nuclear type, by replacing said installations by installations adapted to said energy source while preserving said pressure hull and bulkheads while said internal substitution causes no substantial modification to the weight or gravity-centering of aft section T.

Before describing the installations concerned in greater detail, the method of compartmenting aft section T of the convertible submarine is described.

First, in the lower part of aft section T is compartment 210 containing the aft batteries and compartment 211 reserved for the aft auxiliary motors, both compartments possibly being separated by transverse bulkhead 218. Compartments 210 and 211 are delimited at the top by supporting bulkhead 215 (often called the "floor" by the experts), delimiting in the upper part of aft section T a compartment 213 used for the diesel-generators and a compartment 214 used as electricity room to accommodate the associated electrical equipment which two compartments may be separated by transverse bulkhead 219. Aforementioned compartments 210, 211, 213 and 214 also concern the installations for producing and storing electric energy which have been deliberately grouped together in aft section T and may be removed during the transformation of aft section T so as to convert the vessel for the use of an anaerobic energy source, in particular of the nuclear type. Further, observe that another transverse bulkhead 221 is provided outside aft section T which defines, together with forward transverse bulkhead 217 of said section, an additional adjacent compartment 212 which additional compartment is used as a diesel oil tank. As will be explained in the following, this additional compartment also makes it possible to provide for radiological protection of the forward section of the submarine, after conversion, in such a way as to complete the other radiological protective arrangements provided for elsewhere (but not described here).

The convertible submarine is thus deliberately designed from the outset to be transformed, by the internal substitution of the installations located in aft section T. The areas of the submarine affected by this transformation are hatched in FIGS. 1 and 2: it is clearly observable that aft section T is by far the largest part of the transformed zones of the submarine; the other zones concerned are, on the one hand, the control panel zone 204 of the operation and navigation control station 203 and, secondly, zone 222 of the diesel-generator exhaust circuit located in the substructures outside of pressure hull 101.

Figure 3:
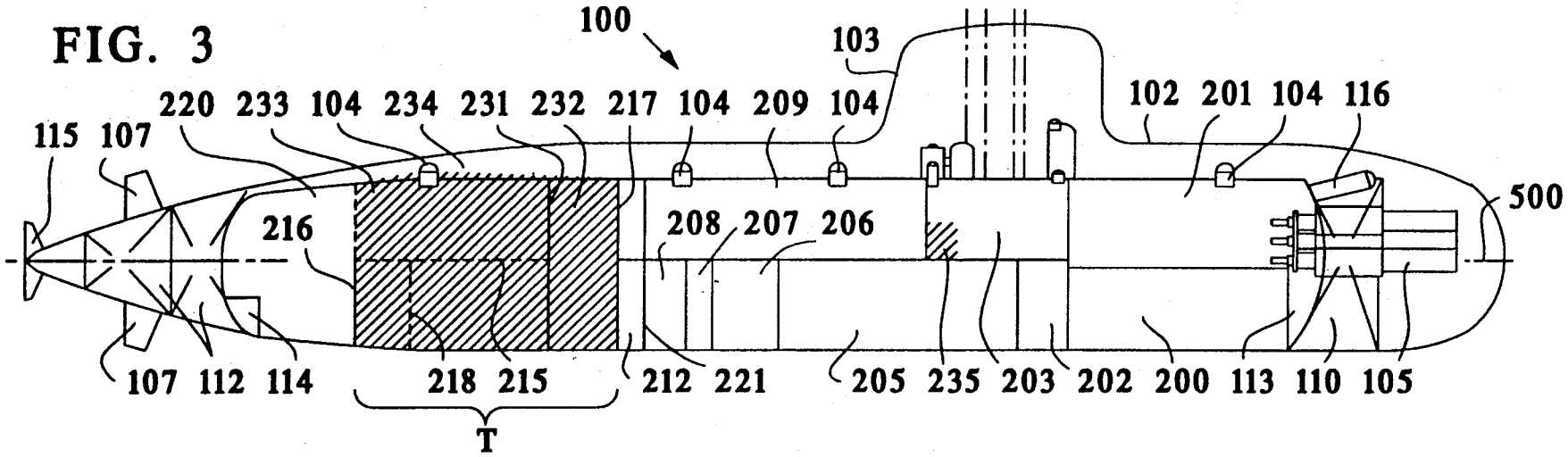
FIGS. 3 and 4 represent sectional views similar to the above, illustrating the same convertible submarine after transformation into an electro-nuclear version while the internal substitution of the installations concerning, more essentially, the aft section (hatching) have no substantial modification upon the weight and the mass centering of said section.
Figure 4:
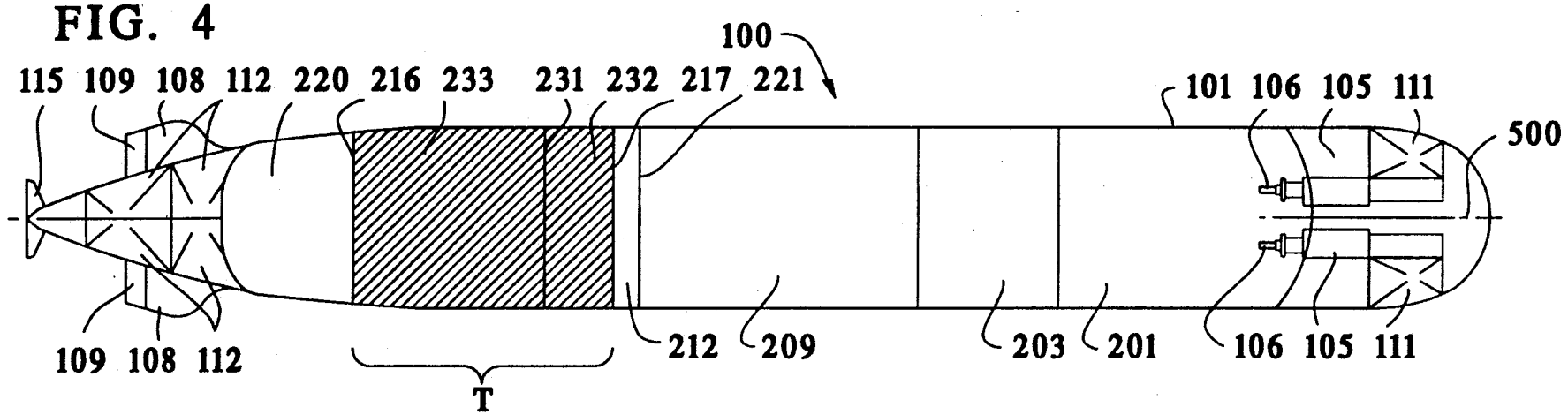

Aft section T of the submarine is thus designed as a real transformable module by internal substitution. Indeed, if we now look at FIGS. 3 and 4, it will be observed that the compartmenting of the aft section has been modified so as to be adapted to accommodate installations associated with an anaerobic energy source, more particularly of the nuclear type, while the remaining structure of the submarine is more or less unchanged. FIGS. 3 and 4 reveal that aft section T no longer includes supporting bulkhead 215; this aft section may, if necessary, include transverse bulkheads 218 and/or 219. In any case, transverse bulkheads 216 and 217 containing aft section T are preserved and an intermediate transverse bulkhead 231 has been added in such a way that there is now a forward compartment 232 capable of containing an electro-nuclear battery unit and an aft compartment 233 capable of housing, on the one hand, a turbo-generator and a condenser associated with the battery, and, in addition, a back-up diesel-generator unit together with the aft auxiliaries. Outside of aft section T, the only areas concerned by the transformation are limited to zone 234 of the exhaust circuit, now associated with the sole back-up diesel-generator and zone 235 of the control panel located in the operation and navigation control station 203.

This concept of convertible naturally imposes conditions upon the initial definition of the submarine and on the definition of the transformation.

In the initial definition, installations liable to be replaced are grouped together in a clearly delimited and specific section, aft section T, relieved as far as possible of any other functions not concerned by the transformation. The passageways needed between the aft and forward parts of this aft section will be grouped together to form clearly determined corridors and specific interfaces must be established for the installations liable to be transformed, for all direct functional links (energy, refrigeration, etc.) or indirect links (zone supervision and safety, transmissions, lighting, ventilation, etc.) and for the integrated characteristics in the general balances and breakdowns of the submarine i.e. more essentially concerning the weight and center of gravity (with variations on patrol), but also with a view to consumption and crew numbers needed for operation.

For the conversion of the vessel, the new installations to be loaded must comply with the same interface conditions as the installations they replace and, of course, with the general technical regulation retained for the design of the submarine. Therefore, it is important that the common interfaces between the two successive generations on the one hand, and the remainder of the submarine on the other hand, contain the strict requirements of both generations and it is desirable to make sure that these needs do not differ excessively.

Accordingly, within the scope of this invention, an original definition of the submarine is proposed which fully anticipates the needs of its conversion.

As mentioned previously, the parts affected by the conversion are essentially those concerning the aft section T. For information, if it is considered that the convertible submarine is divided into 100 couples from C0 to C100, the hull section defining aft section T will be located in the aft quarter of the submarine, between couple C20 and bulkhead C39 i.e. more or less between bulkheads 216 and 217 mentioned above. This corresponds to a length of approximately 12 meters for a coastal submarine, approximately 60 meters in length with a diameter of around 6.2 meters at the outer level of the hull at the forward end while the aft end is slightly truncated.

Various possibilities exist for organizing the unloading of the electric energy production and storage installations using batteries and diesel-generators then for the loading of installations adapted to the anaerobic energy source while preserving the pressure hull and the transverse bulkheads defining aft section T.

Figure 7:
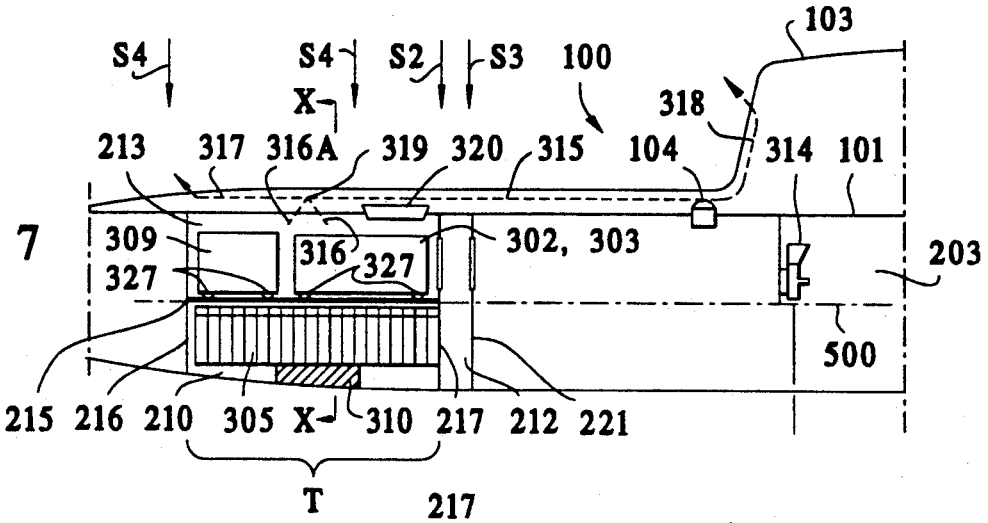
FIG. 7 is a partial end-on view through a vertical plane showing the original installations in the rear transformable section with, more particularly, a logistic panel designed for the removing of the original installations and the subsequent installation of equipment adapted to an anaerobic energy supply and a transformable exhaust system and replaceable diesel-generator control console in the control station of the submarine.

As part of the internal substitution process which is described below, it is intended to install a hull opening or logistic panel (panel 320 in FIG. 7) to permit unloading and loading operations: in this case, the upper part of the section and the hull itself will be designed to permit the installation of a hull opening approximately 2.5 meters in diameter; this arrangement may be anticipated as of the construction of the submarine although it is not essential.

However, it is evident that the internal substitution process mentioned above may be obtained in other ways, more particularly by fully opening the hull by a transverse opening in the area to be transformed. In this case, the interior of aft section T is accessible for the internal substitution of the installations by the transverse cutting of the pressure hull 101; this cut will be made between transverse bulkheads 216 and 217 which contain them, or yet again beyond either of said transverse bulkheads, but near the transverse bulkhead concerned. The position of the four possible transverse cutting planes is identified S1 to S4 in FIG. 7: drawings S1 to S2 correspond to a cut made between transverse bulkheads 216 and 217 which contain aft section T while drawings S3 and S4 concern a cut made beyond said transverse bulkheads but near the bulkheads concerned. This method has the advantage of being able to unload the equipment from the zone in blocks, then loading a mount for the new installations (except for the nuclear battery), after fitting out and testing, so that the additional structural and fitting works may be accomplished with ease. Then, it is simply necessary to close the hull according to the usual construction processes and to re-establish the longitudinal pipe and cable connections. Obviously, this method is all the more easy to consider in that the original design will provide from the outset for a transverse cut in the pressure hull. It should be observed that this method of transformation is an internal method of substitution unlike the addition of a supplementary section which would have the following particular drawbacks: modification of the general characteristics of the submarine, difficulty of optimizing the transformed submarine which would then appear as a hybrid product, difficulty or even impossibility of adding a nuclear unit (in particular for reasons of weight).

Figure 5:
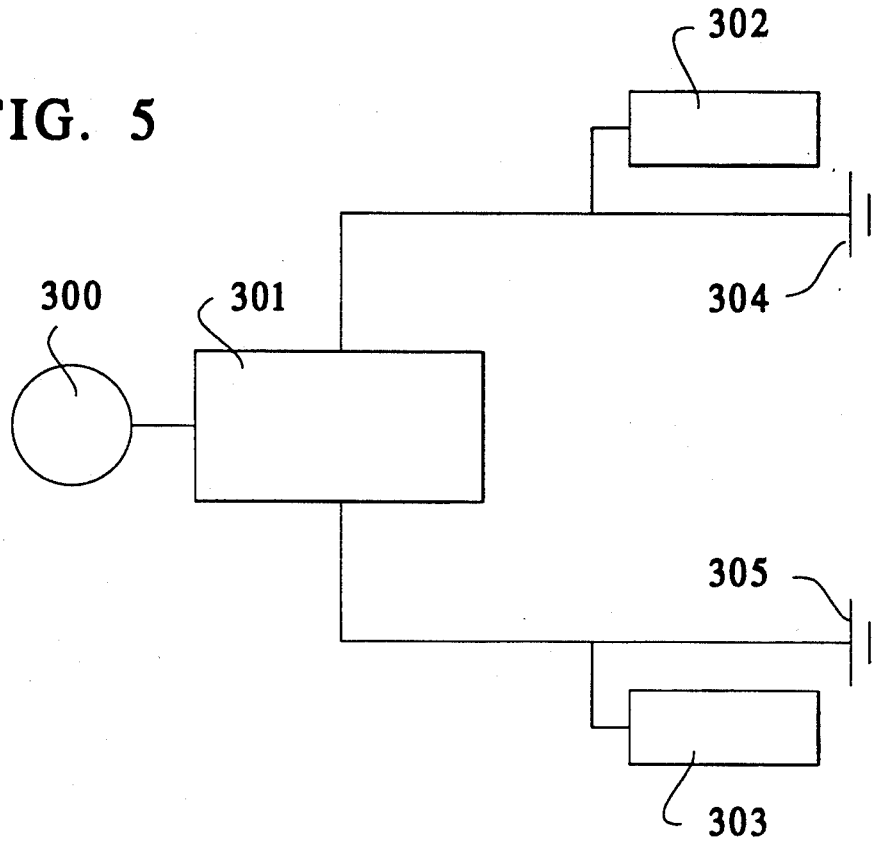
FIGS. 5 and 6 are two diagrams illustrating the system for the production and storage of electric energy respectively in the original version and the transformed version of the previous convertible submarine, the transformation of the aft section according to the principle of internal substitution making it possible to change from the first version to the second.
Figure 6:
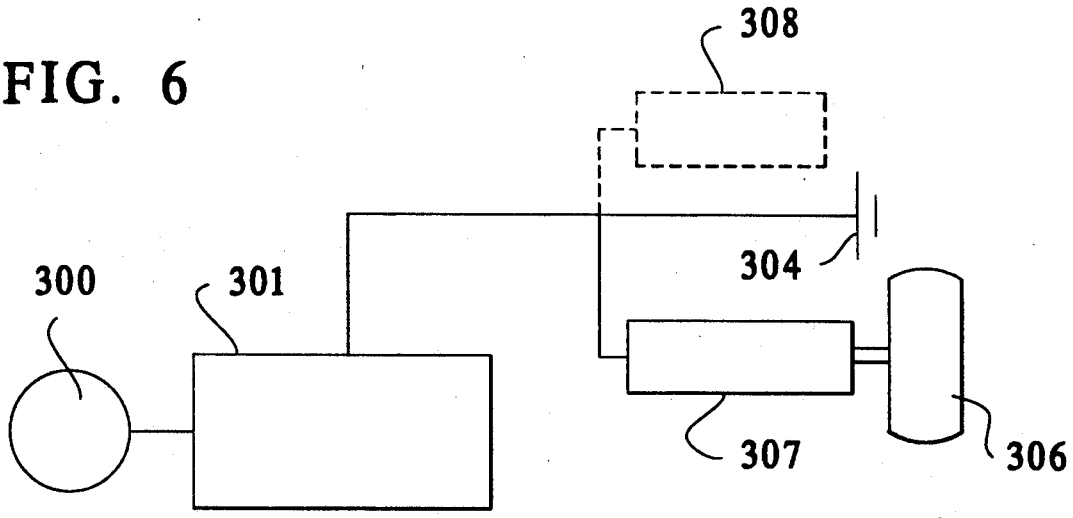

FIGS. 5 and 6 illustrate the production and storage system for electric energy respectively in the original version and the transformed version of the submarine with the transformation of aft section T according to the principle of internal substitution which makes it possible to change operationally from the first to the second version. In the conventional version, there is a propulsion motor 300 connected to a propulsion equipment cabinet 301; this cabinet is connected to forward battery 304 and aft battery 305 with, in addition, a connection to the two diesel-generator units 302 and 303. In the modified version shown in FIG. 6, there is also a propulsion motor 300 and a propulsion equipment cabinet 301 together with forward batteries 304; conversely, there is also an electro-nuclear battery 306 and the associated turbo-generator 307 and advantageously, a back-up diesel-generator 308. Thus, functionally, the transformation to be carried out consists in replacing the electric energy production and storage system shown in the diagram of FIG. 5 by that shown in the diagram of FIG. 6.

FIGS. 7 to 10 provide better distinguishing between the original installations of transformable aft section T.

Figure 8:
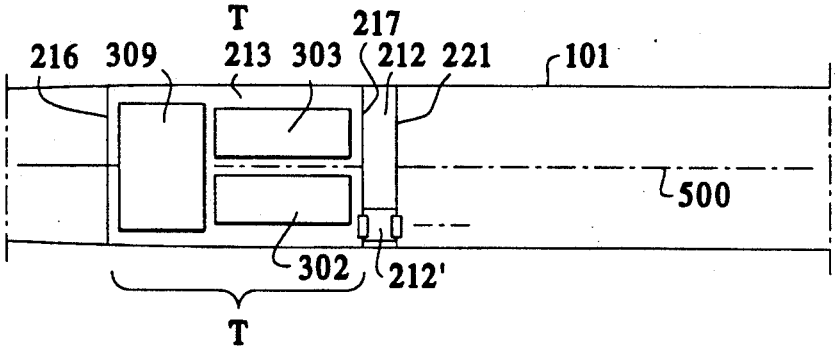
FIGS. 8 and 9 are end-on sectional views in the horizontal plane, respectively of the upper compartment and lower compartment of the rear transformable section shown in FIG. 7
Figure 9:
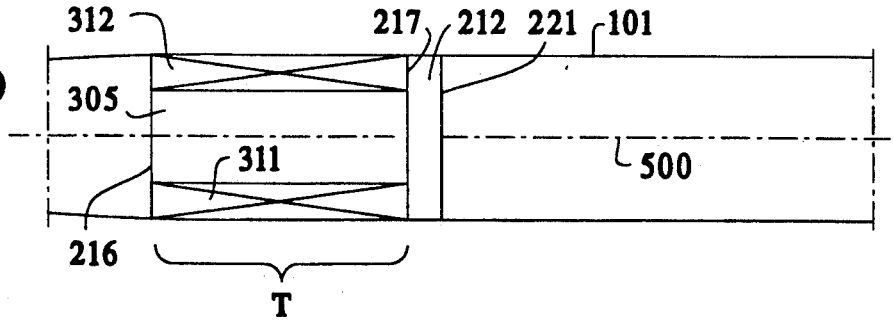
Figure 10:
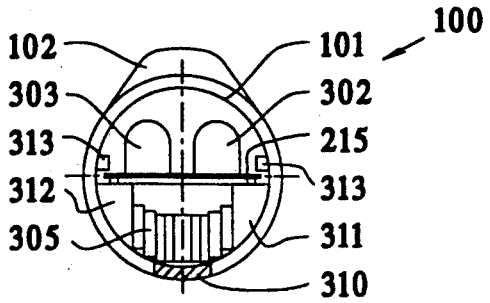
FIG. 10 is a sectional view along X—X of said FIG. 7.
Figure 7A:
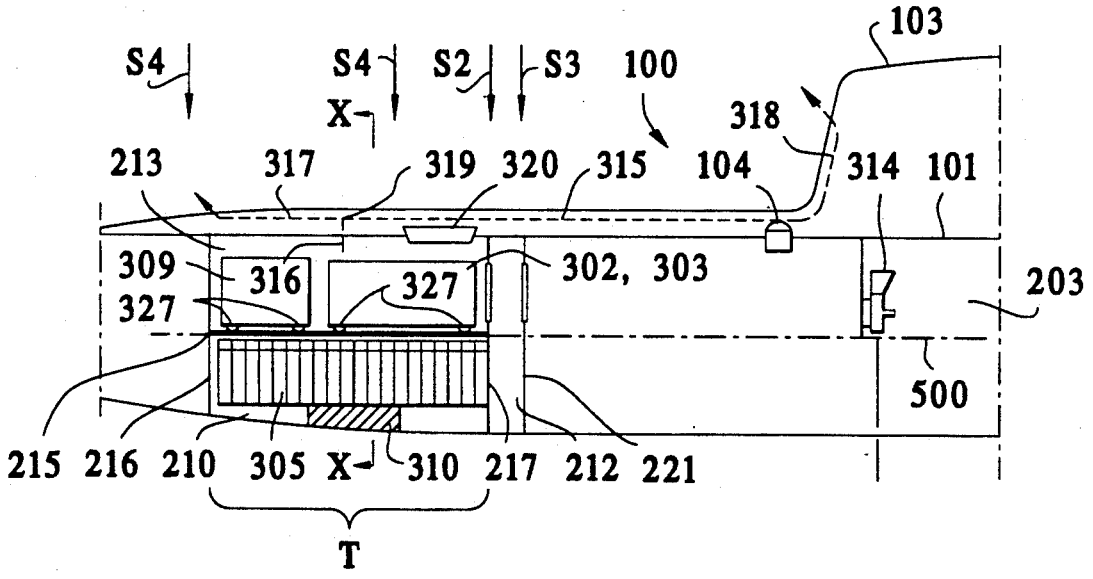
FIG. 7A is a partial end-on view through a vertical plane similar to FIG. 7, showing the simplified exhaust circuit after transformation.

Thus, in lower compartment 210, there is also an aft battery 305 beneath which is a provisional weight 310. This provisional aft weight 310 is designed to allow for the weight of the modified installations which will be loaded subsequently once the original installations have been removed. The weight, provided for instance in the form of blocks of lead, is preferably to be placed beneath the aft battery group 305; however, it is obvious that it could be organized and distributed differently as long as the conditions of weight and centering of the aft section are complied with. In upper compartment 213 are two diesel-generators 302 and 303 together with a set of electric cabinets 309. This equipment rests upon supporting bulkhead 215 through flexible dampers 327 in order to provide for better acoustic discretion. The sections of FIGS. 8 to 10 provide better understanding of how these installations which are housed in aft section T are organized. Convertible submarine 100 also includes an exhaust circuit 315 for the diesel-generators located in the superstructures outside pressure hull 101 which circuit has a first section 316 from which diverge, from a connecting point 319, an aft exhaust part 317 (designed for the exhausting of burned gases from the diesels when the submarine is at the surface), and a forward exhaust section 318 opening out at the calling tower 103 of the submarine: this exhaust circuit, designed with two arms 316, 316A (see FIG. 7) for two diesel-generators, is designed to be transformable within the framework of internal substitution so as to include only a simplified circuit with a single arm 316 (see FIG. 7A) associated with a back-up diesel-generator. In the control station 203, the submarine also includes control console 314 for diesel-generators 302 and 303: this console is also replaceable (in full or in part) within the framework of internal substitution, by another back-up diesel-generator control panel and electronuclear battery.

FIG. 8 corresponding to upper compartment 213 better distinguishes between the two diesel generators 302 and 303 as well as the set of electrical cabinets 309. The sectional view also reveals passage 212' in compartment 212, used as diesel fuel hold and contained by transverse bulkheads 217 and 221.

The sectional view of FIG. 9 corresponds to lower compartment 210 and also discloses aft battery group 305 placed between two side diesel oil tanks 311 and 312. The sectional view of FIG. 10 shows these installations together with the links (electrical, hydraulic and pneumatic, etc.) 313 connecting the submarine forward and aft sections. Observe that the side diesel oil tanks 311 and 312 can be unloaded in the modified version of the convertible submarine because of the tanks provided elsewhere because, in such a version, the diesel oil is only used for back-up propulsion, combined with back-up diesel generator 308. However, the balance of the submarine must be reconstituted requiring the unloading of part of the counterweight because of the weight of the subsequently loaded nuclear battery.

Now, with respect to FIGS. 11 through 16, we will describe the process of transforming the convertible submarine by internal substitution of the installations concerned.

Figure 11:
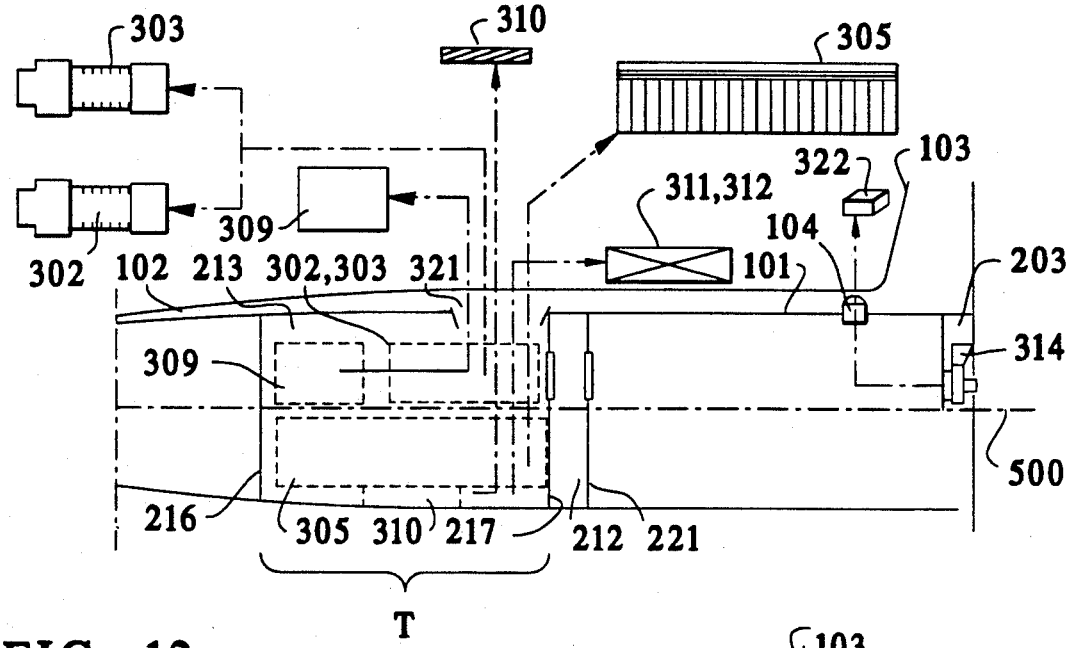
FIG. 11 is a partial end-on sectional view schematizing the unloading of the transformable rear section installations by the logistic panel and of the provisional counterweight housed in that section while the unloading process concerns several other pieces of equipment such as the electrical racks of the control console and the support bulkhead and part of the diesel exhaust system.

FIG. 11 shows the unloading of the original installations housed in aft section T once logistic panel 320 has been removed from the pressure hull. An opening in hull 321 is then defined through which it is possible to unload the installations concerned. Accordingly, aft section T is emptied of the equipment including two diesel-generators 302 and 303, the set of electric cabinets 309, the provisional weight 310, the side diesel oil tanks 311 and 312 and aft batteries 305. Supporting bulkhead 215 is also unloaded together with the zone equipment (not shown here) for lighting, water and fire detection, zone drying, maintenance transmissions, etc. In parallel, the control console of the two diesel-generators in the submarine control station is unloaded: this is schematized is FIG. 11 by the unloading of electric units 322 of control console 314. The same applies to the exhaust system of the two diesels the transformed part of which is unloaded. In practice, the equipment and zone equipment is first unloaded then, during the second stage, internal transformation work is carried out on the structures, casings, cables and pipes relative to the unloaded installations. In this way, the side diesel oil tanks are removed together with the upper aft battery bulkhead, as mentioned previously.

Figure 12:
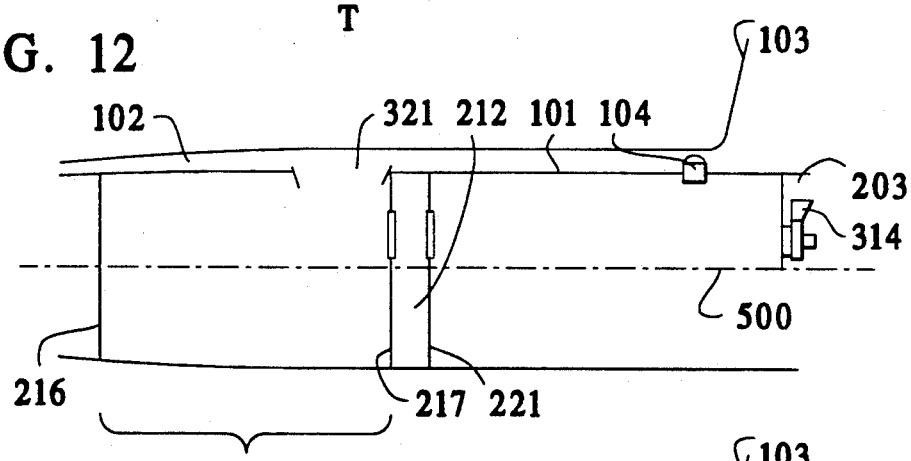

In this way the submarine is brought to the stage shown in FIG. 12 with an aft section T included between the bulkheads 216 and 217 which is entirely emptied except, naturally, for the unchanged links which pass through it (not shown here), for the trim tank circuits, the electric links, pressurized oil, pressurized air, water, etc., connecting the extreme aft section from the remainder of the submarine (links 313 in the sectional view of FIG. 10). Therefore, it is important to observe that bulkheads 216 and 217 delimiting rear section T are concerned by this transformation.

Figure 13:
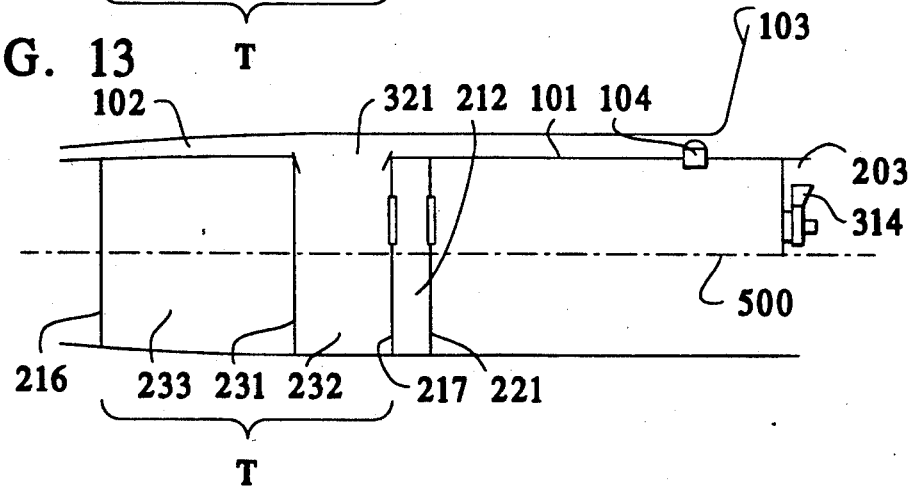
FIG. 13 illustrates the same section after the addition of an intermediate transverse bulkhead.

As shown in FIG. 13, the intermediate transverse bulkhead 231, the aft bulkhead of the nuclear battery compartment is assembled. The bulkheads of the passageway are also assembled together with the supports for the battery. Once these bulkheads are assembled, it is no difficult matter to mount the standby diesel supporting jig, that of the turbo-generator, and the associated circuits.

Figure 14:
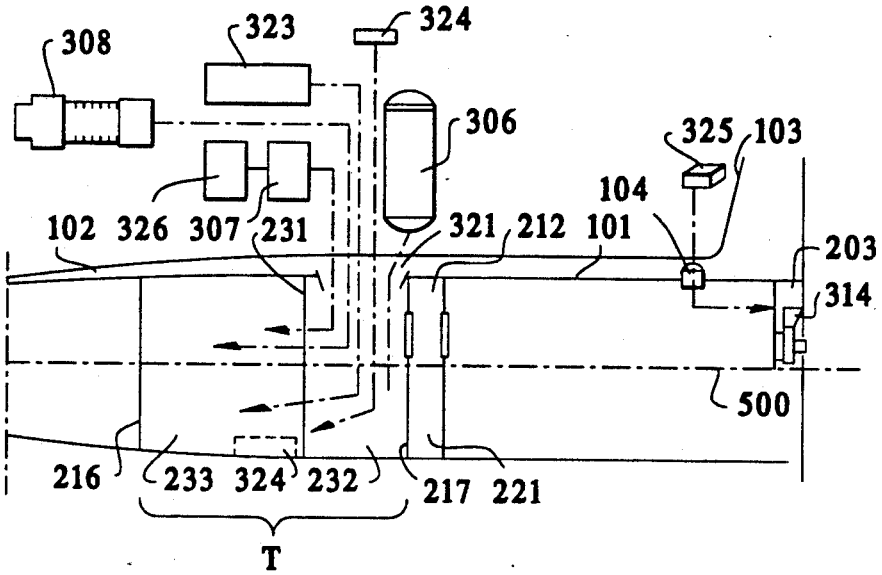
FIG. 14 is a partial end-on sectional view schematizing the loading, by the logistic panel, of installations adapted to the anaerobic energy source with, in the present case, an electro-nuclear battery unit, a turbo-generator and a capacitor associated with the battery as well as a back-up diesel-generator and a modified balancing weight with, in addition, another control console for the back-up diesel-generator unit and the electro-nuclear battery.

FIG. 14 illustrates the loading of the aft section equipment. The hull opening 321 is used again to load this equipment, together with the modified ballast 324, the back-up diesel-generator 308, turbo-generator 307 and the condenser 323 associated with electro-nuclear battery 306 as well as the associated electrical equipment and the atmospheric regeneration equipment with the overall reference 326. Once this equipment has been loaded and arranged in aft compartment 233, it is then possible to load the electro-nuclear battery unit 306 in forward compartment 232; this unit is lowered directly to hull opening 321 by known lifting facilities not shown here. To permit the passage of equipment loaded through bulkhead 231, a removable panel (not referenced here) is provided in this bulkhead. Alternately, it is possible to use the aft logistic panel (not shown), often provided for to the benefit of the propulsion electric motor 300 and to organize the routing of this equipment from said panel except for nuclear battery unit 306 which is loaded through logistic panel 320 as indicated previously.

In this way, it is simply necessary to assemble the connections (mechanical links, piping, electrical links), and to mount the zone equipment. In parallel to this work within the transformed section, the simplified diesel exhaust circuit is reformed in the superstructure so that it now concerns only back-up diesel-generator 308 and, finally, the control console of the back-up diesel and nuclear battery is assembled in the submarine control station and connected: this is schematized in FIG. 14 by the loading of electrical units 325 associated with control console 314. Accordingly, as an alternate solution, the control console cabinet can be substituted in its entirety.

The on-board logistic stock is then adapted to the new definitions. In this way it is possible to carry out tests to terminate the convertible submarine transformation. The submarine is then brought into the configuration shown in FIGS. 15 and 16.

Figure 15:
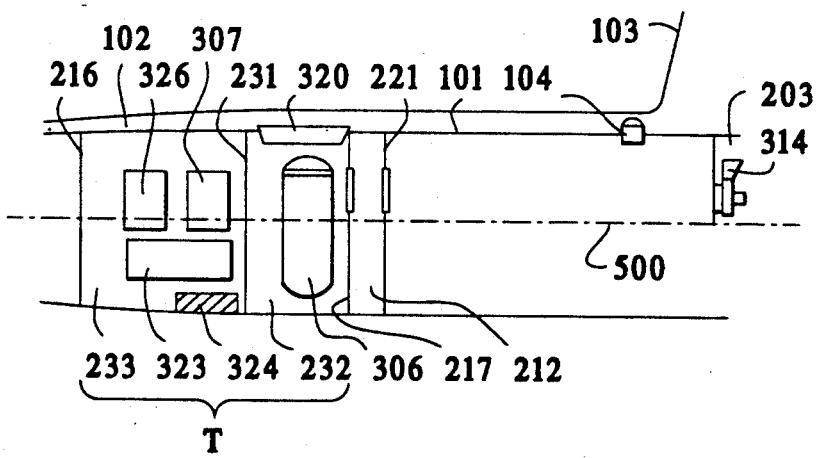
FIGS. 15 and 16 are partial end-on sectional views respectively in the vertical and horizontal planes of the transformed rear section.
Figure 16:
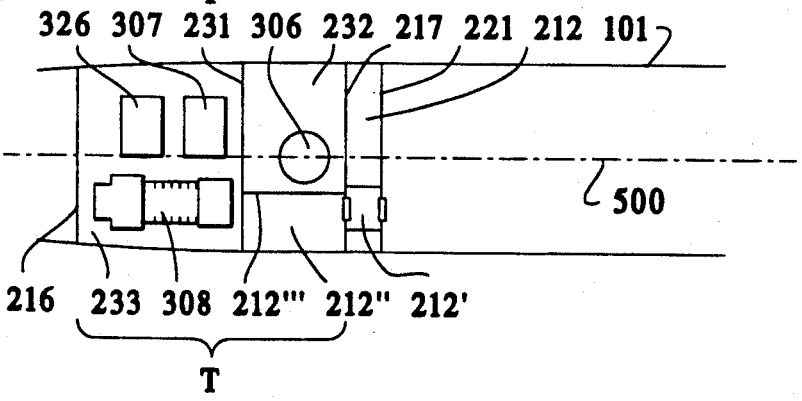

FIG. 15 also indicates the modified ballast 324, condenser 323, turbo-generator 307 and the aforementioned complementary equipment 326 arranged in aft compartment 233 together with the electro-nuclear battery unit 306 located in forward compartment 232 which is closed by the reassembly of logistic panel 320. In FIG.

16, in aft compartment 233 are back-up diesel-generator 308, turbo-generator 307 and complementary equipment 326. This figure also indicates, in forward compartment 232, extension 212'' of passage 212' in compartment 212 which extension 212'' is isolated from the nuclear battery by bulkhead 212'''. Civil radiological protection standards for the forward zone (permanently occupied) are easily complied with thanks to the diesel oil hold placed ahead of the nuclear battery i.e. compartment 212 which compartment is unchanged during the transformation process: indeed, radiological protection is provided by the diesel oil itself or by replacement sea water when the diesel oil has been consumed.

Longitudinal balancing of the weights is obtained by the original architecture of the submarine which provides for identical section weights in the two successive versions. The general characteristics of the submarine (dimensions and tonnage) are unchanged. Therefore, the submarine acquires extreme anaerobic capacity and mobility without losing any other capabilities or any modification to its other functions. In particular, its steering conditions remain unchanged because the shape and stability of the submarine are not modified.

The concept of convertibility used within the present invention offers considerable advantages. First, it considerably improves the deployment capacities and engagement conditions of the submarine. These improvements concern the capacity to travel beneath the water at the highest possible speed. Therefore, the improvements concern the various capabilities of the submarine including the patrolling distance of the submarine with its anaerobic capability, the maximum discreet sailing autonomy underwater, the range underwater, the discreet transit speed, the capability to maintain a high hunting speed underwater, and the total possible range on patrol.

The concept of convertibility is also a way of preserving the technical capabilities of the submarine in terms of compliance with its overall balance. This concerns weight evaluation at zero trim and zero list, with stability in various sailing configurations, and the capacity to adjust the balance of the submarine with the consumption of materials and variation of sea water densities liable to occur during the assigned missions. In this way, it becomes possible to preserve a balance between the production-storage side and the consumption side for the various energy balances, for heat evacuation and for materials: electric energy into the different networks, high pressure oil, high pressure air, refrigeration, air conditioning, water, etc. It also becomes possible to maintain safety, steering conditions, atmospheric control conditions, leakage and fire monitoring conditions and various safety measures. Finally, it also becomes possible to maintain military capabilities (e.g. resistance to submarine explosions) and the conditions of submarine operation.

The concept of convertibility is also a way of considerably restricting transformation works, important with a view to financial considerations. The precise topological limitations of the transformed aft section make it possible to preserve entirely, during the transformation, anything installed outside the zone, as well as the general envelope of the zone i.e. the pressure tight hull and the bulkheads containing it, passages of all types which simply pass through the zone, and the access and crossing capacities of said zone for man and equipment.

The invention is not limited to the production mode described here but, to the contrary, contains all variants which use the essential characteristics given in the claims by equivalent means.

We claim:

1. A convertible submarine comprising:

a pressure tight hull;

an aft section bounded by the pressure tight hull, a forward transverse bulkhead and an aft transverse bulkhead, comprising a first energy source installation for production and storage of electric energy, comprised of at least one battery and at least one diesel-generator set;

said aft section being transformable to convert said submarine to use of an anaerobic energy source by replacing said first energy source installation by said anaerobic installation while preserving said pressure tight hull and said forward and aft transverse bulkheads, without causing major modification to center of gravity and displacement characteristics of said aft section.

2. A convertible submarine according to claim 1, wherein the aft section further comprises:

a lower compartment containing at least one battery located between two side diesel oil tanks and provisional ballast; and an upper compartment housing two diesel-generator sets resting upon a supporting bulkhead along with associated electrical equipment;

said compartments being transformable by removal of said supporting bulkhead and by addition of an intermediate transverse bulkhead which divides the aft section into an aft section forward compartment capable of housing an electro-nuclear battery and an aft section aft compartment capable of housing a turbo-generator and a condenser combined with said battery and, in addition, a back-up diesel-generator unit, a modified ballast for weight balancing also located in at least one of said aft section forward and aft compartments.

3. A convertible submarine according to claim 2, wherein said submarine further comprises:

a diesel exhaust circuit located in superstructures outside the pressure tight hull, said circuit having an aft exhaust section and a forward exhaust section opening out at a sail of said submarine, said circuit being transformable to include only a simplified circuit associated with the back-up diesel-generator set.

4. A convertible submarine according to claim 2, further comprising a steering station comprised of a control console for the diesel-generator sets, said console being replaceable by another control console for the back-up diesel-generator and electro-nuclear battery after transformation.

5. A convertible submarine according to claim 1, wherein the aft section forward transverse bulkhead defines with another transverse bulkhead, outside and forward of the aft section, a supplemental compartment adjacent to said aft section, which supplemental compartment comprises a diesel oil tank which further is capable of providing radiological protection for a forward zone of said submarine.

6. A convertible submarine according to claim 5, wherein the aft section forward transverse bulkhead extends radially to abut the pressure tight hull, while the aft section transverse bulkhead extends radially to enclose at least a lower compartment.

7. A convertible submarine according to claim 6, wherein the aft transverse bulkhead extends radially to abut the pressure tight hull, such that the pressure tight hull and the forward and aft transverse bulkheads completely enclose the aft section aft compartment.

8. A convertible submarine according to claim 1, wherein the aft section has a logistic panel located within the pressure tight hull to allow internal access for unloading the first energy source installation and loading the anaerobic energy source replacement installation for internal substitution during transformation.

9. A convertible submarine according to claim 8, wherein the logistic panel is located in the upper part of the aft section and near the forward transverse bulkhead.

10. A convertible submarine according to claim 8, wherein the logistic panel is located adjacent and aft of the aft section forward transverse bulkhead.

11. A convertible submarine according to claim 1, wherein the aft section interior is accessible for the internal substitution of energy source installations by a transverse cut in the pressure tight hull, said cut being made between the transverse bulkheads delimiting the aft section.

12. A convertible submarine according to claim 1, wherein the aft section interior is accessible for the internal substitution of energy source installations by a transverse cut in the pressure tight hull, said cut being made beyond said transverse bulkheads delimiting the aft section, but near one said transverse bulkhead.

13. A convertible submarine according to claim 1, wherein said anaerobic energy source is a nuclear energy source.

14. A method for converting a submarine from use of a first energy source to use of a second anaerobic energy source comprising:

removing from said submarine a first energy source installation comprising at least one battery and at least one diesel-generator set from an aft section of said submarine defined by a pressure tight hull and a forward transverse bulkhead and an aft transverse bulkhead; and installing into said aft section an anaerobic energy source installation, while preserving said pressure tight hull and said forward and aft transverse bulkheads and without causing major modification to center of gravity and displacement characteristics of said aft section.

15. A method according to claim 14, further comprising removing said first energy source battery, two diesel-generator sets and associated electrical equipment, and an aft section lower compartment supporting bulkhead, and adding an intermediate transverse bulkhead thereby dividing the aft section into an aft section forward compartment and an aft section aft compartment, and installing in the aft section forward compartment an electro-nuclear battery, and in the aft section compartment a turbo-generator and a condenser combined with said battery and, in addition, a back-up diesel-generator set, and in at least one of said aft section forward and aft compartments a modified ballast for weight balancing.

16. A method according to claim 14, further comprising transforming a diesel exhaust circuit located in superstructures outside the pressure tight hull, said circuit having an aft exhaust and a forward exhaust section opening out at a sail of said submarine, to provide only a simplified circuit associated with the back-up diesel-generator set.

17. A method according to claim 14, further comprising replacing a steering station control console for the diesel-generator sets with a control console for a back-up diesel-generator and an electro-nuclear battery.

18. A method according to claim 14, Wherein said anaerobic energy source is installed through a logistic panel located within the pressure tight hull in an upper part of the aft section.

19. A method according to claim 18, further comprising installing an intermediate transverse bulkhead aft of the logistic panel before installing the anaerobic energy source.

20. A method according to claim 14, further comprising making a transverse cut in the pressure tight hull, and said cut being made at one of;

1) between the transverse bulkheads delimiting the aft section, and 2) beyond said transverse bulkheads, but near one said transverse bulkhead, and installing the anaerobic energy source through the transverse cut.

* * * * *